US007513276B2

(12) United States Patent
Westerkamp

(10) Patent No.: US 7,513,276 B2
(45) Date of Patent: Apr. 7, 2009

(54) METHOD FOR THE PRODUCTION OF A PAPER-MACHINE SCREEN

(75) Inventor: Arved H. Westerkamp, Dettingen/Erms (DE)

(73) Assignee: Voith Patent GmbH, Heidenheim (DE)

( * ) Notice: Subject to any disclaimer, the term of this patent is extended or adjusted under 35 U.S.C. 154(b) by 47 days.

(21) Appl. No.: 11/490,369

(22) Filed: Jul. 20, 2006

(65) Prior Publication Data

US 2007/0028992 A1 Feb. 8, 2007

(30) Foreign Application Priority Data

Jul. 23, 2005 (DE) ..... 10 2005 034 453

(51) Int. Cl.
*D21F 7/08* (2006.01)
*D21F 7/02* (2006.01)
*D03D 25/00* (2006.01)

(52) U.S. Cl. ..... 139/383 A; 139/383 R; 162/358.2

(58) Field of Classification Search ..... 139/383 A; 162/348, 358.2, 900
See application file for complete search history.

(56) References Cited

U.S. PATENT DOCUMENTS

| | | | | |
|---|---|---|---|---|
| 1,826,654 | A * | 10/1931 | Deboutteville | 139/1 R |
| 2,792,851 | A | 5/1957 | Moeckel | 139/383 |
| 5,074,339 | A | 12/1991 | Vöhringer | 139/383 A |
| 5,988,229 | A * | 11/1999 | Quigley | 139/383 A |
| 6,148,869 | A * | 11/2000 | Quigley | 139/383 A |
| 6,207,598 | B1 * | 3/2001 | Lee et al. | 442/206 |
| 6,227,256 | B1 * | 5/2001 | Quigley | 139/383 A |
| 6,237,644 | B1 * | 5/2001 | Hay et al. | 139/383 A |
| H1974 | H * | 7/2001 | Lee et al. | 442/206 |
| 6,276,402 | B1 * | 8/2001 | Herring | 139/383 A |
| 6,349,749 | B1 * | 2/2002 | Quigley | 139/383 R |
| 6,413,377 | B1 * | 7/2002 | Wright | 139/383 A |
| 2003/0024590 | A1 * | 2/2003 | Stone | 139/408 |
| 2004/0094223 | A1 * | 5/2004 | Johnson et al. | 139/383 A |
| 2004/0104005 | A1 * | 6/2004 | Brewster et al. | 162/358.2 |
| 2004/0182466 | A1 * | 9/2004 | Johnson et al. | 139/383 R |
| 2007/0028992 | A1 * | 2/2007 | Westerkamp | 139/383 A |

FOREIGN PATENT DOCUMENTS

| | | | |
|---|---|---|---|
| DE | 42 29 828 | A1 | 3/1994 |
| WO | WO 02/00996 | A1 | 1/2002 |

* cited by examiner

*Primary Examiner*—Bobby H Muromoto, Jr.
(74) *Attorney, Agent, or Firm*—Taylor & Aust, P.C.

(57) ABSTRACT

A method for the production of a paper-machine screen with a paper-side ply of weft threads and a run-side ply of weft threads and with at least two warp thread systems interwoven in each case with the paper-side weft threads and/or the run-side weft threads, each warp thread system being assigned a group of heald frames, by means of which the warp threads of the warp thread systems are to be moved for shedding, including the generation of a draft diagram with a draft repeat for the warp thread systems, in which draft repeat a subrepeat recurring in the draft repeat is provided for at least one of the warp thread systems.

10 Claims, 3 Drawing Sheets

METHOD FOR THE PRODUCTION OF A PAPER-MACHINE SCREEN

BACKGROUND OF THE INVENTION

1. Field of the Invention

The present invention relates to a method for the production of a paper-machine screen with a paper-side ply of weft threads and a run-side ply of weft threads.

2. Description of the Related Art

Paper-machine screens of this type serve, in paper-making, for receiving from a feed system a basic paper material which is generally in the form of a fiber suspension. This basic material is distributed over a large area on a paper-machine screen of this type or between two paper-machine screens of this type. During further manufacture, water can be extracted through the orifices of the fiber suspension which are present in such a screen. An essential requirement of such paper-machine screens is that a paper produced thereby reproduces as little as possible the fabric structure of the paper-side fabric ply. That is to say, a structure-free paper surface which is as smooth as possible.

A paper-machine screen of this type with two fabric plies is known from DE 42 29 828 A1. A paper-side fabric ply includes a paper-side ply of weft threads which are interwoven with warp threads of a first warp thread system assigned to the paper-side fabric ply. A second fabric ply includes run-side weft threads which are interwoven with the warp threads of a second warp thread system which are assigned to the run-side fabric ply. In order to ensure cohesion between these two fabric plies, there are binding weft threads, as they are known, which tie off alternately via warp threads of the run-side fabric ply and warp threads of the paper-side fabric ply. It would, of course, also be conceivable to use binding warp threads here, that is to say to provide a further warp thread system ensuring the mutual binding of the two fabric plies.

WO 02/00996 A1 discloses a paper-machine screen likewise with two plies of weft threads, to be precise a paper-side ply with somewhat thinner weft threads and a run-side ply with somewhat thicker weft threads. Two warp thread systems are provided such that the warp threads of one system and the warp threads of the other system are assigned to one another in each case in pairs, and these respective pairs of warp threads from two different warp thread systems alternate with one another when they are tied into or tied onto the run-side weft threads and paper-side weft threads, so that, on the one hand, a very fine fabric structure, for example with a linen weave, is obtained on the paper side, but, on the other hand, a connection of the two fabric plies is also at the same time achieved by means of these threads.

SUMMARY OF THE INVENTION

The present invention provides a method for the production of a paper-machine screen which has a lower tendency to marking during paper-making.

According to the invention, a method for the production of a paper-machine screen with a paper-side ply of weft threads and a run-side ply of weft threads and with at least two warp thread systems interwoven in each case with the paper-side weft threads and/or the run-side weft threads, each warp thread system is assigned a group of heald frames, by way of which the warp threads of the warp thread systems are to be moved for shedding, the method including the generation of a draft diagram with a draft repeat for the warp thread systems, in which draft repeat a subrepeat recurring in the draft repeat is provided for at least one of the warp thread systems.

The method according to the invention is based on the recognition that the development of stresses within the paper-machine screen is an essential factor contributing to the generation of markings in the paper. This development of stresses, which is assisted essentially by highly uniform patterns or high symmetries, is counteracted, according to the invention, in that, as early as during the definition of the draft, that is to say the assignment of individual warp threads of the various warp thread systems to specific heald frames, the build-up of defined stresses is counteracted by a deliberately introduced irregularity. This therefore means that, in the case of a specific weave pattern to be woven, which generally has comparatively high uniformity, a draft diagram with deliberately introduced or increased non-uniformity is superposed, in order thereby, as early as during shedding which greatly influences the stress profile within a then woven screen, to counteract the build-up of undesirable stresses within the paper-machine screen.

For example, in the method according to the invention, there may be no subrepeats provided in the draft repeat of at least one warp thread system. This therefore means that, in this at least one warp thread system, the draft pattern recurs within the draft diagram merely by a plurality of draft repeats being joined to one another, but not within each individual draft repeat.

Alternatively or additionally, there may be provision, in the draft repeat, for a recurring subrepeat to be provided in each case for at least two warp thread systems, and for the numbers of recurrences of the subrepeats in the draft repeat to differ from one another. Thus, even when, in at least two warp thread systems, subrepeats are in each case provided within a draft repeat, these arise with different numbers of recurrences within the draft repeat or each draft repeat, and non-uniformity within the draft repeat can be achieved.

According to further aspects, in the method according to the invention, there may be provision, in the draft repeat, for at least the group of heald frames which is assigned to a warp thread system to comprise heald frames directly succeeding one another in the warp direction. Alternatively, the draft pattern or draft diagram can thereby be varied further in the direction of greater non-uniformity when, in the draft repeat, at least the groups of heald frames which are assigned to two different warp thread systems are nested one in the other in the warp direction.

Since, in general, in the production of paper-machine screens, an attempt is made to keep the number of heald frames used as low as possible, there may further be provision, according to the invention, in the draft repeat, for at least one heald frame to be assigned to two warp threads of the same warp thread system. This, of course, depends greatly on the weave structure to be achieved in the fabric plies.

The method according to the invention can be employed particularly advantageously in the production of paper-machine screens on weaving machines with at least 25 heald frames, preferably at least 27 heald frames and particularly preferably at least 30 heald frames.

The present invention relates, furthermore, to a paper-machine screen produced by means of a method according to the invention.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
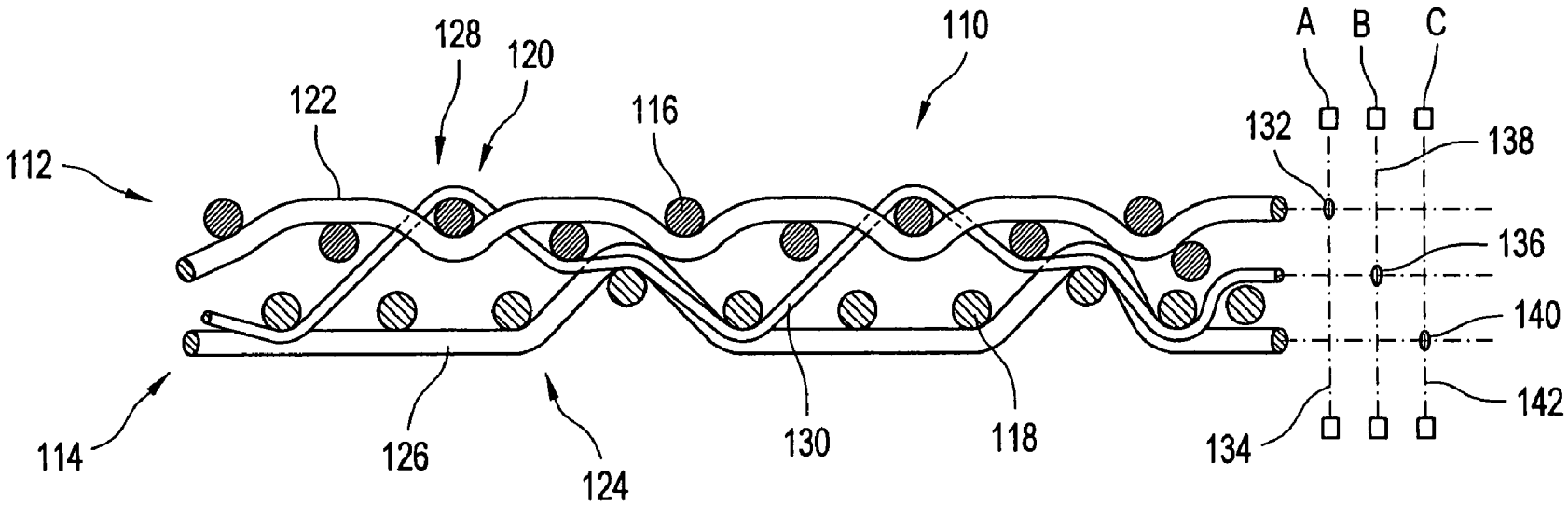
FIG. 1 shows a section through a paper-machine screen produced with two fabric plies, in the warp direction.

In FIG. 1, a paper-machine screen which can be produced according to the principles of the present invention is illustrated in the form of a detail and in longitudinal section through the warp and is designated in general by 110. This paper-machine screen is constructed with two fabric plies 112, 114. The fabric ply 112 is a paper-side fabric ply, that is to say provides, on the side lying on top in FIG. 1, that surface on which the fiber suspension used for paper-making is applied and subsequently the paper is formed.

Fabric ply 114 is to be interpreted as the run-side fabric ply. This fabric ply therefore comes into interaction with the wheels or rollers guiding or even driving the paper-machine screen 110. The fabric ply 112 comprises a paper-side ply of weft threads 116, whilst the fabric ply 114 comprises a run-side ply of weft threads 118. As is known, these weft threads 116 and 118 extend essentially transversely with respect to the direction of manufacture of the paper-machine screen 110. Furthermore, to provide the paper-side fabric ply 112, a first warp thread system 120 with warp threads 122 is provided. These warp threads 122 are interwoven with the weft threads 116 of the paper-side ply of weft threads, in which case, for example, the weft threads 116 may form, with the warp threads 122 of the first warp thread system 120 which lie next to one another in the weft direction, a linen weave, a twill weave or the like.

The run-side fabric ply 114 comprises, in addition to the run-side ply of weft threads 118, a second warp thread system 124 with warp threads 126. These warp threads 126 are interwoven with the weft threads 118 of the run-side ply of weft threads, and here a weave pattern can be selected which can best fulfil the requirements arising particularly with regard to mechanical stress and abrasion on the run side.

In order, in the paper-machine screen illustrated in FIG. 1, to ensure the cohesion of the two fabric plies 112, 114, a third warp thread system 128 for the warp threads 130 is provided. These warp threads 130 of the third warp thread system 128, which, for example, are designed to be thinner in comparison with the warp threads 122 or 126, tie off alternately with the weft threads 116 of the paper-side fabric ply 112 and the weft threads 118 at the run-side fabric ply 114. Since, of course, the third warp thread system 128 has a plurality of such warp threads 130 in the weft direction, a stable composite structure of the two fabric plies 112, 114 is ensured over the entire area of the paper-machine screen 110.

In the production of paper-machine screens of this type, in general, heald looms with a multiplicity of heald frames arranged successively in the warp direction are used for shedding the warp threads 122, 126, 130 of the various warp thread systems 120, 124, 128. Of these huge frames, the heald frames A, B and C are indicated diagrammatically in FIG. 1. The heald frame A, illustrated to represent symbolically a group of healds as explained in more detail below, co-operates with the warp thread 122 of the first warp thread system 120. For this purpose, this warp thread 122 is led through a loop 132 of a heald 134 of the heald frame A. Correspondingly, the heald frame B co-operates with the warp thread 130 of the third warp thread system 128, since this warp thread 130 is led through a loop 136 of a heald 138 of the heald frame B. Finally, the heald frame C co-operates with the warp thread 126 of the second warp thread system 124, in that this warp thread 126 is led through a loop 140 of a heald 142 of this heald frame C. For shedding, therefore, these heald frames A, B and C are occupied in the vertical direction, in order thereby to position the warp thread co-operating with a respective heald frame in the correct plane with respect to a weft thread to be introduced, that is to say above or below the latter. It may be pointed out, in actual fact, that the number of heald frames to be provided or to be used for shedding depends on the weave pattern to be implemented. It may be necessary, within a weave repeat, considered in the weft direction, for each warp thread of a specific warp thread system, on the one hand, to provide a specific heald frame, so that this warp thread can be moved independently of all the other warp threads of this warp thread system, and, on the other hand, per se to provide in each case specific groups of heald frames for the various warp thread systems, so that warp threads defining the respective warp thread systems assigned to these can be moved independently of the warp threads of other warp thread systems for shedding. In actual fact, therefore, the heald frames A, B and C illustrated in FIG. 1 are representative in each case of the groups of heald frames which are assigned to the individual warp thread systems and which include at least two heald frames, but, in general, include more than two heald frames, as also explained below.

Before a paper-machine screen 110 of this type can be woven on a weaving machine during the execution of a weaving operation, it is necessary to generate a draft diagram, that is to say to provide an assignment between the respective warp threads of the various warp thread systems and the heald frames provided on the weaving machine or the heald frames of the groups of heald frames assigned to the various warp thread systems. This is explained below, with reference to FIG. 2, by way of a first variant of the invention.

Figure 2:
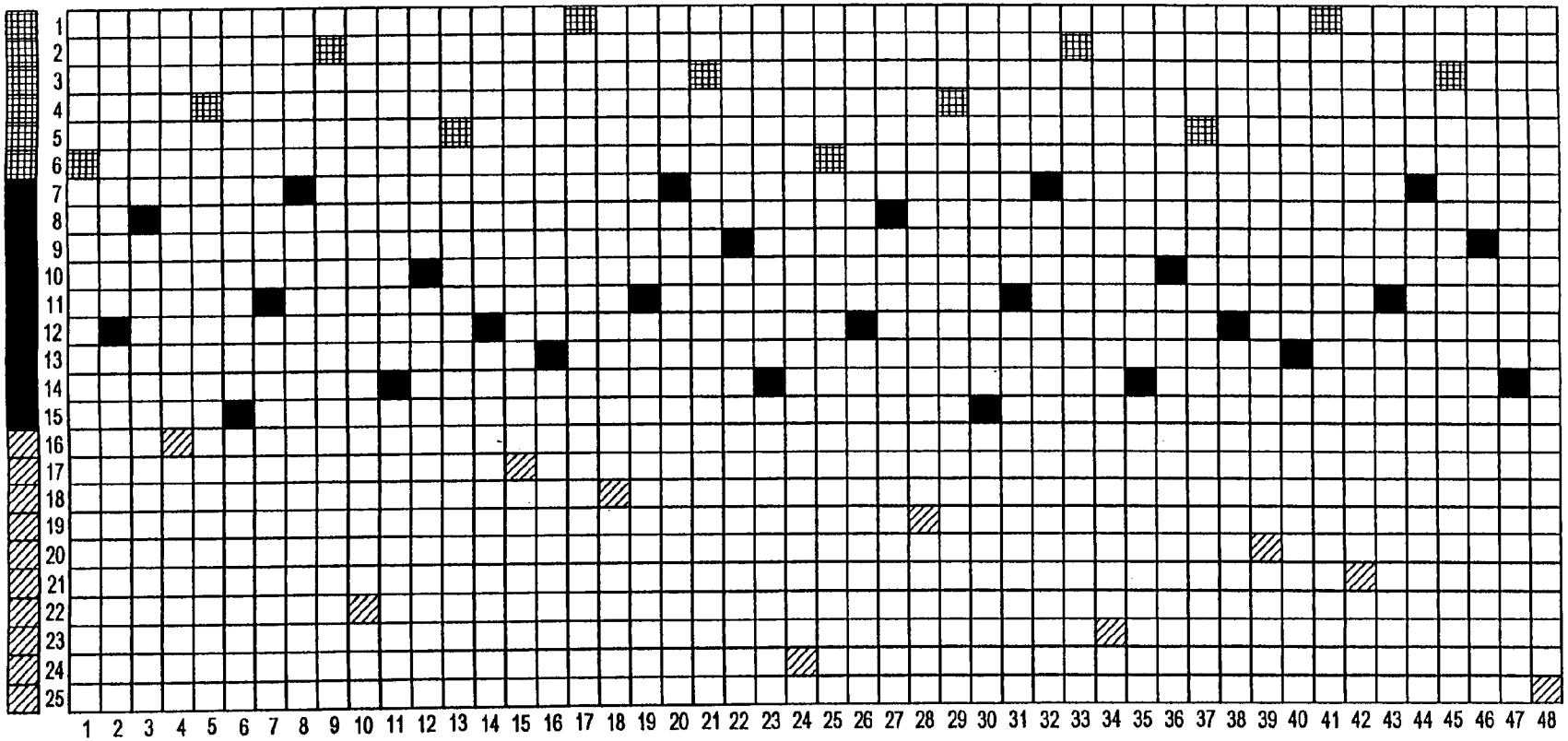
FIG. 2 shows an illustration of a draft repeat implemented according to the principles of the present invention.

FIG. 2 illustrates the draft diagram with the operation of weaving a paper-machine screen illustrated by way of example in FIG. 1, the draft diagram being constructed according to the principles of the present invention. In this case, FIG. 2 illustrates a draft repeat, that is to say a portion, considered in the weft direction, which represents a unit then recurring in the weft direction, that is to say multiply lined up. In an illustration of FIG. 2, the horizontal rows of small boxes, which are numbered from 1 to 25, correspond to the heald frames used for production. This therefore means that 25 heald frames are used in the instance illustrated. The vertical columns of small boxes represented in each case a warp thread, here therefore a draft repeat comprising 48 warp threads. On the right-hand side of the draft repeat illustrated, that is to say on the right of the warp thread 48, if appropriate, the next draft repeat would follow, starting with the warp thread 1, whilst, on the left-hand side of the draft repeat illustrated, if appropriate, a further draft repeat would follow with its warp thread 48.

In the draft diagram illustrated in FIG. 2 by way of a draft repeat, each marked small box represents the interaction of a specific warp thread with a specific heald frame. Thus, for example, the heald frame 1 co-operates with the warp threads 17 and 41. This means that these warp threads 17 and 41 are led in each case through loops of healds of the heald frame 1, so that, in the event of a vertical movement of the heald frame 1, these two warp threads 17 and 41 are moved for shedding. The same, of course, also applies correspondingly to all the other heald frames 2 to 25 and to the warp threads, co-operating with these, of the respective draft repeat having the warp threads 1 to 48.

Figure 3:
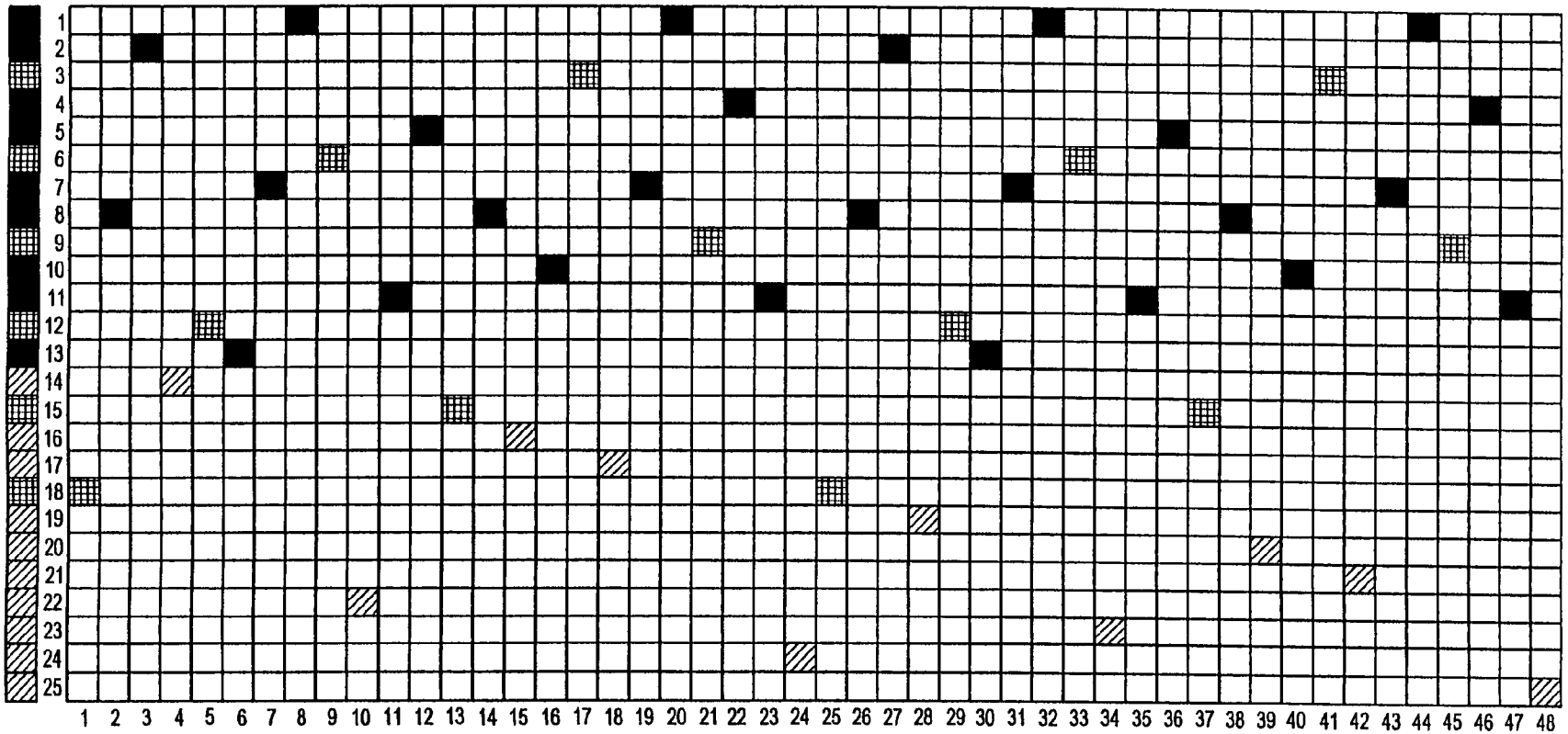
FIG. 3 shows an illustration of a further draft repeat constructed according to the principles of the present invention.

In the illustration of FIG. 3, the warp threads of the three warp thread systems 120, 124 and 128 already explained above with reference to FIG. 1 are illustrated with a different pattern. Thus, the warp threads illustrated by a checkered pattern or crossed lines and bearing the numbers 1, 5, 9, 13, 17, 21, 25, 29, 33, 37, 41, 45 are the warp threads of the first warp thread system 120, that is to say those which, together with the weft threads 16, form the paper-side fabric ply. The warp threads 4, 10, 15, 18, 24, 28, 34, 39, 42 and 48 illustrated by oblique hatching are the warp threads of the second warp thread system 124, that is to say those warp threads which, together with the weft threads 118, form the run-side fabric ply 114. The remaining warp threads, that is to say the warp threads 2, 3, 6, 7, 8, 11, 12, 14, 16, 19, 20, 22, 23, 26, 27, 30, 31, 32, 35, 36, 38, 40, 43, 44, 46, 47 marked black are the warp threads of the third warp thread system 128, that is to say those warp threads which implement the mutual binding of the two fabric plies 112, 114.

The co-operation of the warp threads of the various warp thread systems with the heald frames 1 to 25 is illustrated in the pattern bar which can be seen on the left in FIG. 2. It can be seen that the warp threads of the first warp thread system 120 co-operate with the heald frames 1 to 6, in that the warp threads of the third warp thread system 128 co-operate with the heald frames 7 to 15 and that the warp threads of the second warp thread system 124 co-operate with the heald frames 16 to 25. It may be stressed, here, that the numbering of the heald frames indicates the sequence of these heald frames in the warp direction and in the weaving direction. Respective groups of heald frames are therefore provided in assignment to each warp thread system 120, 124 and 128, the group assigned to the first warp thread system 120 comprising the heald frames 1 to 6, the group assigned to the second warp thread system 124 comprising the heald frames 16 to 25, and the group assigned to the third warp thread system 128 comprising the heald frames 7 to 15. It can further be seen in FIG. 2 that the heald frames of the individual groups succeed one another directly in the warp direction, so that there is also a direct sequence of these three groups of heald frames 1 to 6, 7 to 15 and 16 to 25 without any intermixing.

It can further be seen from the draft repeat illustrated in FIG. 2 that this smallest unit of the draft diagram which recurs for all three warp thread systems 120, 124 and 128 has subrepeats in assignment to the two warp thread systems 120 and 128, that is to say the warp threads illustrated by a checkered pattern and the warp threads illustrated black. That is to say, within the draft repeat defined for all three warp thread systems, there is in each case an even smaller recurring pattern unit for the two warp thread systems 120 and 128. In the case of the warp threads of the warp thread system 120, that is to say the warp threads co-operating with the heald frames 1 to 6, the associated subrepeat includes six warp threads, that is to say, for example, the warp threads 1, 5, 9, 13, 17 and 21. The draft pattern of these warp threads which is formed as a result of co-operation with the heald frames 1 to 6 recurs from the warp thread 25 of this warp thread system 120. That is to say, within the draft repeat of FIG. 2, the subrepeat assigned to the first warp thread system 120 is present twice. The same also applies correspondingly to the third warp thread system 128. Here, too, within the draft repeat, the assigned subrepeat is present twice, specifically once with the warp threads 2, 3, 6, 7, 8, 11, 12, 14, 16, 19, 20, 22, 23. The second recurrence then has the warp thread 26 as the first warp thread arising in the numbering sequence, and comprises, furthermore, the warp threads 27, 30, 31, 32, 35, 36, 38, 40, 43, 44, 46, 47.

The pattern of this type which recurs within the draft repeat does not exist in the second warp thread system, that is to say the warp threads co-operating with the heald frames 16 to 25. Here, the next recurrence takes place in actual fact only at the next recurrence of the draft repeat, this ultimately also being the basis for the fact that the draft repeat including all three warp thread systems 120, 124 and 122 extends over the warp threads 1 to 48.

By subrepeats or a subrepeat being provided in assignment to at least one of the warp thread systems, whilst no subrepeat exists for at least one other warp thread system and its pattern recurs in actual fact only at the next recurrence of the draft repeat, a draft diagram is generated which, during a weaving operation which is then carried out, contributes to suppressing as far as possible the build-up of stresses in a paper-machine screen produced in this way. A comparatively unordered draft pattern is superimposed on the weave pattern arising with comparatively high periodicity, which obviously has a positive effect in the prevention of such stresses. The most diverse possibilities of variation may, of course, be envisioned. Thus, for example, in the configuration of a draft repeat, as illustrated in FIG. 2, a subrepeat could also be provided only in assignment to a single one of the three warp thread systems 120, 124 and 128, whilst the draft pattern recurs only every 48 threads in the other two warp thread systems. The division of the subrepeat or of the subrepeats with respect to the draft repeat could also be different. Thus, for example, a subrepeat could be present thrice or more often in the draft repeat. It is also conceivable that, when there are subrepeats in assignment to two warp thread systems, these subrepeats do not arise with the same division, but instead, for example in one of the warp thread systems, a pattern defined by a subrepeat arises twice in the draft repeat, whilst, in another warp thread system, the pattern defined by a subrepeat arises thrice or more often. Also, the principles of the present invention are applied when, for example, there are only two warp thread systems. In the case of the draft repeat illustrated in FIG. 2, this could mean that, for example, the heald frames 7 to 15 are inactive or are absent, so that only the two groups of heald frames 1 to 6 (in assignment to the first warp thread system 120) and 16 to 25 (in assignment to the second warp thread system 124) are present. In the case of such a draft repeat or draft diagram, for example, a paper-machine screen would then be produced which has no warp threads serving essentially only for the mutual binding of the fabric plies 112, 114, but, instead, a paper-machine screen in which connection also takes place simultaneously by way of the warp threads of the two warp thread systems which are interwoven with the weft threads.

In the example presented above, this, too, would then ensure that there is a subrepeat in assignment to the first warp thread system 120, specifically a subrepeat arising twice in the draft repeat, whilst there is no subrepeat in assignment to the second warp thread system 124. Even if only two warp thread systems are used, it would be conceivable that there is then in each case a subrepeat in both warp thread systems, in which case the division of the subrepeats must necessarily be different, that is to say, for example, one subrepeat recurs twice in the draft repeat, whilst the other subrepeat recurs thrice or arises thrice in the draft repeat. If, in this case, both or all the subrepeats were to arise with the same division, this would in actual fact constitute a reduction of the overall draft repeat to the size of the subrepeats, with the result that, within a draft repeat then defined in this way, a subrepeat with an even finer configuration would not be present in any of the warp thread systems.

A further possibility of variation is illustrated in FIG. 3. It can be seen in FIG. 3 that the heald frames, co-operating with the warp threads of the various warp thread systems, of the various groups of heald frames do not define a block formation taking place in the warp direction, but, instead, a nesting of the individual groups one in the other is present. Thus, in this case, the heald frames 3, 6, 9, 12, 15 and 18 are active in assignment to the first warp thread system 120, that is to say the warp threads illustrated by crossed lines. The heald frames 14, 16, 17 and 19 to 25 are active in assignment to the second warp thread system 124, that is to say the warp threads symbolized by oblique hatching, whilst the heald frames 1, 2, 4, 5, 7, 8, 10, 11 and 13 are active in assignment to the third warp thread system 128, that is to say the warp threads implementing the mutual binding of the fabric plies 112, 114. Nevertheless, here too, a subrepeat recurring in the draft repeat is present in each case in assignment to the warp threads of the first warp thread system 120 and the warp threads of the third warp thread system 128, whereas this is not the case with regard to the warp threads of the second warp thread system 124. The result of this nesting of the groups of heald frames one in the other is that a further-increased "disorder" in the assignment of the heald frames to warp threads is present in the draft diagram including a draft repeat thus defined or the recurrences of such a repeat, this being reflected in a corresponding more or less quasi-statistical solution of the shedding pattern. This, too, makes a further contribution to avoiding a highly regular pattern or shedding pattern and consequently also to reducing the stresses then present in the fabric.

It will be appreciated that, even in the design variant illustrated in FIG. 3, the possibilities of variation explained above in relation to FIG. 2 may be utilized in terms of the configuration of the subrepeats. Overall, it may be stated, as regards the draft pattern selected within the subrepeats or even in the case of that warp thread system which has no subrepeat, that, for example, draft patterns known from textile weaving may be adopted here. Thus, straight drafts with an S-draft or Z-draft may be selected, as may staggered drafts or jump drafts. A diamond draft, that is to say a single diamond draft or multiple diamond draft, an interrupted diamond draft or a broken diamond draft, may also be employed. The same applies, of course, to composite drafts and heald-frame section drafts.

In conclusion, it may also be pointed out that FIGS. 2 and 3 show that heald frames can co-operate with a single warp thread or else can co-operate with a plurality of warp threads. This depends primarily on which weave pattern is to be woven and which of the warp threads are always to be moved jointly for shedding for this purpose. In general, it will be advantageous to keep the number of heald frames used as low as possible, so that, if possible, as many warp threads as possible should co-operate in each case with one heald frame. In this case, it must, of course, be remembered that, because the warp threads of various warp fed systems are to be moved basically independently of one another, a heald frame in actual fact also always co-operates only with warp threads of one warp thread system.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for the production of a paper-machine screen with a paper-side ply of weft threads, a run-side ply of weft threads, and at least two warp thread systems including a first warp thread system and a second warp thread system, each said warp thread system interwoven with at least one of the paper-side ply of weft threads and the run-side ply of weft threads, said method comprising the step of generating a draft diagram with a draft repeat for said first and second warp thread systems of the paper-machine screen, each of said first and second warp thread systems including a plurality of warp threads and being assigned a respective group of heald frames by which said warp threads of said first and second warp thread systems can be moved for shedding, said draft diagram specifying an assignment of each said warp thread of said first and second warp thread systems respectively to a specific said heald frame, a recurring subrepeat being provided in said draft repeat for at least said first warp thread system, said subrepeat including at least two warp threads of said first warp thread system being assigned to a same one of said heald frames in said draft repeat.

2. The method of claim 1, wherein no subrepeat is provided in said draft repeat for at least said second warp thread system.

3. The method of claim 1, wherein said recurring subrepeat is provided in said draft repeat for at least two warp thread systems, and wherein a number of recurrences of the subrepeats in said draft repeat differ from one another.

4. The method of claim 1, wherein in said draft repeat, at least a group of heald frames assigned to one of said warp thread systems includes heald frames succeeding one another in a warp direction.

5. The method of claim 1, wherein in said draft repeat, at least a plurality of groups of heald frames which are respectively assigned to two different said warp thread systems are nested one in the other in a warp direction.

6. The method of claim 1, wherein in said draft repeat, at least one said heald frame is assigned to two warp threads of a same said warp thread system.

7. The method of claim 1, wherein said paper-machine screen is woven on a weaving machine with at least 25 heald frames.

8. The method of claim 7, wherein said paper-machine screen is woven on a weaving machine with at least 27 heald frames.

9. The method of claim 8, wherein said paper-machine screen is woven on a weaving machine with at least 30 heald frames.

10. A paper-machine screen manufactured by the method of claim 1.

* * * * *